US011751316B2

(12) United States Patent
Duncan et al.

(10) Patent No.: US 11,751,316 B2
(45) Date of Patent: Sep. 5, 2023

(54) POWER TRANSFER AND MONITORING DEVICES FOR X-RAY TUBES

(71) Applicant: Gulmay Limited, Surrey (GB)

(72) Inventors: Stuart Duncan, Surrey (GB); Tony Durrant, Surrey (GB)

(73) Assignee: GULMAY LIMITED, Surrey (GB)

( * ) Notice: Subject to any disclaimer, the term of this patent is extended or adjusted under 35 U.S.C. 154(b) by 0 days.

(21) Appl. No.: 16/674,969

(22) Filed: Nov. 5, 2019

(65) Prior Publication Data

US 2021/0136900 A1 May 6, 2021

(51) Int. Cl.
*H05G 1/26* (2006.01)
*H05G 1/12* (2006.01)

(52) U.S. Cl.
CPC ..... *H05G 1/265* (2013.01); *H05G 1/12* (2013.01)

(58) Field of Classification Search
CPC ..... H05G 1/12; H05G 1/085; H05G 1/265; H05G 1/46; H05G 1/54; G01R 19/0092; G01R 1/203
See application file for complete search history.

(56) References Cited

U.S. PATENT DOCUMENTS 3,878,455 A * 4/1975 Ochmann ..... H05G 1/26 324/404
3,974,387 A * 8/1976 Bronner ..... H05G 1/34 378/112
4,277,683 A * 7/1981 Schmitmann ..... H05G 1/265 378/98
4,311,913 A * 1/1982 Resnick ..... H05G 1/34 378/101
4,322,797 A * 3/1982 Lickel ..... H05G 1/34 708/801
4,775,992 A * 10/1988 Resnick ..... H05G 1/34 378/112

(Continued)

FOREIGN PATENT DOCUMENTS

WO 2012/080899 A1 6/2012

OTHER PUBLICATIONS

Patent Act 1977: Search Report under Section 17 for Application No. GB1807366.8; dated Oct. 24, 2018 (2 pages).

*Primary Examiner* — Dani Fox
*Assistant Examiner* — Soorena Kefayati
(74) *Attorney, Agent, or Firm* — MH2 TECHNOLOGY LAW GROUP LLP

(57) ABSTRACT

A power transfer and monitoring device for an X-ray tube may include: an X-ray filament; a transformer including a primary coil and a secondary coil, wherein the secondary coil of the transformer includes a first leg, a second leg, and a middle leg; a current supply configured to supply a sinusoidal current to the primary coil of the transformer; and a calculation unit configured to measure a primary current of the transformer, configured to determine a synthesized transformer magnetizing current, and configured to subtract the synthesized transformer magnetizing current from the primary current of the transformer to determine a value of filament current through the X-ray filament. The first and second legs of the secondary coil of the transformer alternately supply current to a first end of the X-ray filament. The middle leg of the secondary coil of the transformer supplies current to a second end of the X-ray filament.

11 Claims, 3 Drawing Sheets

(56) References Cited

U.S. PATENT DOCUMENTS 5,067,143 A * 11/1991 Watanabe ..... H05G 1/34 378/109
5,121,317 A * 6/1992 Vogler ..... H05G 1/20 363/136
5,272,618 A * 12/1993 Blake ..... H02M 3/3378 363/79
5,339,349 A * 8/1994 Xeno ..... H05G 1/34 378/207
6,298,116 B1 * 10/2001 Methley ..... H05G 1/12 378/103
8,981,799 B2 * 3/2015 Nakazato ..... G01R 19/0092 324/123 R
2004/0247080 A1 * 12/2004 Feda ..... H05G 1/44 378/101
2005/0036344 A1 * 2/2005 Baptiste ..... H05G 1/265 363/59
2006/0165220 A1 * 7/2006 Takahashi ..... H05G 1/10 378/109
2006/0274887 A1 * 12/2006 Sakamoto ..... H05G 1/12 378/104
2008/0309258 A1 * 12/2008 Lin ..... H05B 41/2988 315/309
2009/0257560 A1 * 10/2009 Khutoryansky ..... H05G 1/10 29/606
2011/0241575 A1 * 10/2011 Caiafa ..... H05G 1/32 315/379
2012/0294428 A1 * 11/2012 Oketa ..... H02M 7/48 363/55
2013/0251108 A1 * 9/2013 Luerkens ..... H05G 1/10 378/106
2015/0137795 A1 * 5/2015 Wiedmann ..... H05G 1/265 324/157
2017/0118830 A1 4/2017 Totsuka et al.
2017/0223814 A1 * 8/2017 Matilaine ..... H05G 1/34
2017/0231076 A1 * 8/2017 Louvrier ..... A61B 6/5211
2017/0238405 A1 * 8/2017 Magnuson ..... H01F 38/18 378/107
2017/0290136 A1 * 10/2017 Wiedmann ..... H05G 1/34
2018/0063932 A1 * 3/2018 Leibl ..... H05G 1/12
2018/0063934 A1 * 3/2018 Obata ..... H05G 1/52
2018/0064410 A1 * 3/2018 Li ..... A61B 6/582
2018/0239052 A1 * 8/2018 Teague ..... H05G 1/54
2018/0315579 A1 * 11/2018 Yonezawa ..... H01J 37/244
2019/0159326 A1 * 5/2019 Proell ..... H05G 1/14
2019/0165668 A1 * 5/2019 Sakabe ..... H02M 1/08
2019/0327822 A1 * 10/2019 Waffler ..... H01J 35/025
2020/0088769 A1 * 3/2020 Jin ..... H02M 3/33576
2020/0137862 A1 * 4/2020 Kawaguchi ..... H05G 1/12
2020/0357598 A1 * 11/2020 Demura ..... H01J 35/24

* cited by examiner

POWER TRANSFER AND MONITORING DEVICES FOR X-RAY TUBES

The present specification relates to X-ray tube monitoring, particularly monitoring the resistance of an X-ray tube filament.

BACKGROUND

Field

A known type of X-ray generator includes an X-ray tube in which a cathode is heated, and the electrons from the cathode are accelerated to an anode, where the electrons produce an X-ray Photon flux. The cathode or electron emitter is typically a wound filament which has a current passed through it, and the X-ray Photon flux is related to the emission current from an electron emitter. The electron emission is directly related to the electrical filament power. There is therefore an important characteristic of any X-ray tube which relates the filament is power (voltage and current) to the emission current and photon flux at a given kV. This also means that the tube gain characteristic could be measured at the same time.

It would also be advantageous if the resistance of the filament could be continuously monitored in order to predict the X-ray tube's lifespan and warn when failure is to be expected.

Description of Related Art

Typically, X-ray tubes operate from a few kV up to 500 kV and beyond. The filament voltage, which is normally only a few volts, is referenced to the Extra High Tension (EHT) voltage across the X-ray tube. This means that to measure either filament current or voltage, whilst EHT is applied, is extremely difficult.

If a filament measurement circuit was inserted between the generator and the tube, then the power to drive the measuring circuit would need to be supplied through a large isolation transformer; this would require the whole circuit to be placed in a tank full of insulating material such as transformer oil, and the output signal similarly isolated, before being fed back to be displayed; this itself is problematic, and transmission using fibre optics may be necessary. This would be an extremely cumbersome and expensive solution, and impractical in most normal situations.

SUMMARY

A first objective of the present invention is to enable current and voltage data to be extracted for a resistive load (such as a wire wound filament of an X-ray tube) held at high voltage, such that a relationship between the load current, load voltage and electron emission current can be measured and continuously is monitored.

In an X-ray tube this emission current gives rise to an X-ray photon flux, which is the gain of the X-ray tube. With this data a characteristic gain plot of an X-ray tube can be produced.

An alternative but related objective of the present invention is to enable the trend toward end of life of the filament to be predicted.

This can be done by monitoring the filament current and voltage required to deliver a given electron emission current. The resistance of the filament can be calculated, so that as the filament wears and "thins" and its resistance increases the trend toward ultimate failure can be predicted.

According to the present invention, there is provided an X-ray tube monitoring system according to claim 1.

This system allows monitoring signals (principally the current, but voltage can be similarly calculated) to be extracted without having to connect directly to the filament. This allows filament life prediction; additionally, it allows gain plots for X-ray tubes to be easily generated.

BRIEF DESCRIPTION OF THE DRAWINGS

The invention will now be described, by way of example, with reference to the drawings, of which

DETAILED DESCRIPTION

Figure 1:
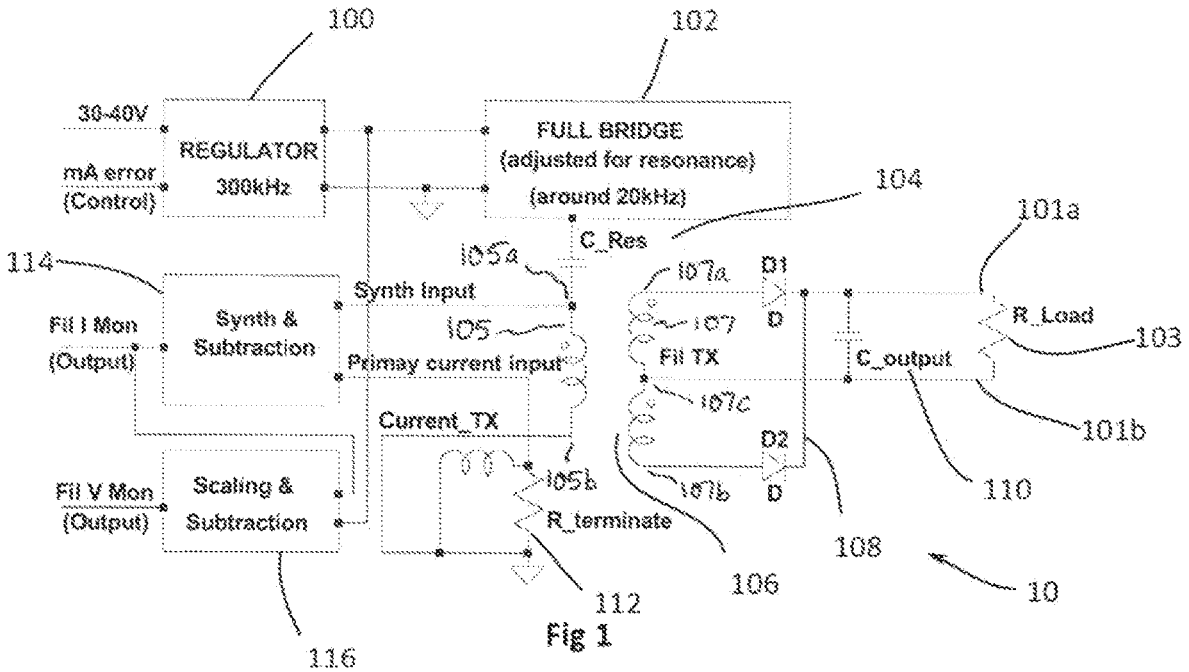
FIG. 1 is a diagrammatic representation of the monitoring system according to an embodiment of the invention.

Referring to FIG. 1, power transfer and monitoring device 10 has regulator 100 supplying a direct current (DC) voltage to full bridge switching converter 102. The frequency of full bridge switching converter 102 is adjusted until resonance is achieved between C_Res 104 and the leakage inductance of transformer 106, so that a sinusoidal current of a single frequency is generated, that is, having no harmonic frequencies. Transformer 106 comprises primary coil 105 and secondary coil 107. Primary coil 105 includes first leg 105*a* and second leg 105*b*, while secondary coil 107 includes first leg 107*a*, second leg 107*b*, and middle leg 107*c*.

As the transformer primary current is sinusoidal, it means that the transformer secondary current also is sinusoidal. The transformer secondary voltage is full wave rectified using, for example, rectification circuit 108, and smoothed using, for example, capacitor C_output 110, before being applied to the first and second ends 101*a*, 101*b* of the X-ray filament R_Load 103.

Large leakage inductances are associated with transformers with a large isolation tolerance; to reduce the effects of leakage inductance, a sinusoidal current drive is used. The full bridge resonant converter allows a square wave voltage drive to be used to provide a sinusoidal current drive. The current wave-shape contains very few harmonics, and therefore there is a fixed relationship between the DC filament current and the transformer secondary current. If then the transformer primary current were measured, this would be proportional to transformer secondary current if it wasn't for the transformer magnetising current giving an error. To correct for this error, the transformer magnetising current is determined (or "synthesised") and is subtracted from the transformer primary current to allow determination of the transformer secondary current and, hence, the filament current.

The transformer primary current is measured using a current transformer terminated in resistor R_terminate 112. From the primary voltage, a signal which is proportional to the transformer magnetising current is produced. This is subtracted from the signal proportional to the transformer primary current in synthesis and subtraction unit 114, yielding a signal which is proportional to the transformer secondary current and, hence, the filament current. The resulting filament current monitor is then used in voltage scaling and subtraction unit 116 to yield the filament voltage. A calculation unit comprises synthesis and subtraction unit 114 and voltage scaling and subtraction unit 116. The relationships between $I_{Load}$ and $I_{Secondary}$, $I_{Primary}$, $I_{Secondary}$ and $I_{Magnetising}$, and $I_{Monitor}$ and $I_{primary}$ and $I_{Magnetising}$ are as follows:

$$I_{Load} \propto I_{Secondary}$$

$$I_{Primary} \propto I_{Secondary} + I_{Magnetising}$$

$$I_{Mon} \propto I_{Primary} - I_{Magnetising}$$

Figure 2:
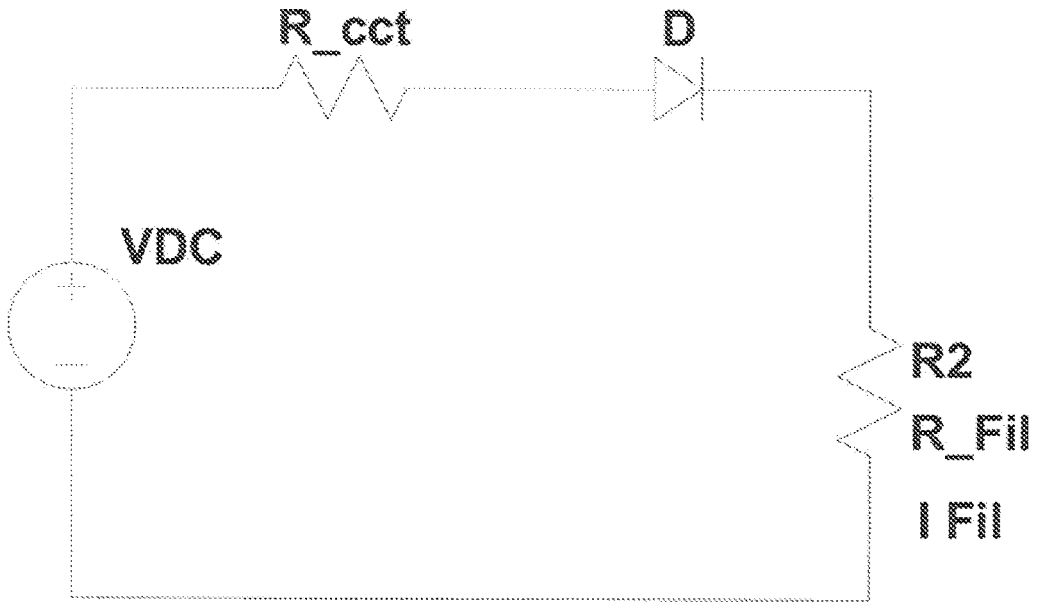
FIG. 2 is a diagrammatic representation of an approximate equivalent circuit of the system of FIG. 1.

The system model approximates to a voltage generator in series with a diode and resistor as shown in FIG. 2. If the voltage drop across the diode is known, and the value of R-cct is known together with the filament current, then by measuring VDC, the voltage across the filament can be deduced. To obtain these values, a measurement is carried out on the filament before EHT is applied. The filament characteristic is first plotted. Then, EHT is applied, and by calibrating the system back to the zero High Voltage measurement, a matching plot of the filament characteristic is produced.

Once this calibration has been done once for a given filament, the voltage can then be measured continuously through the life of the filament. From this a continuous gain plot of the X-ray tube can be produced through to the life of the filament.

As a filament wears, the core becomes thinner, until the point where it is destroyed. As the core becomes thinner, the filament resistance increases. If a measurement is taken at the start of life, and the filament is monitored throughout its life, the end of life can be predicted as the filament resistance starts to increase rapidly approaching failure.

Figure 3:
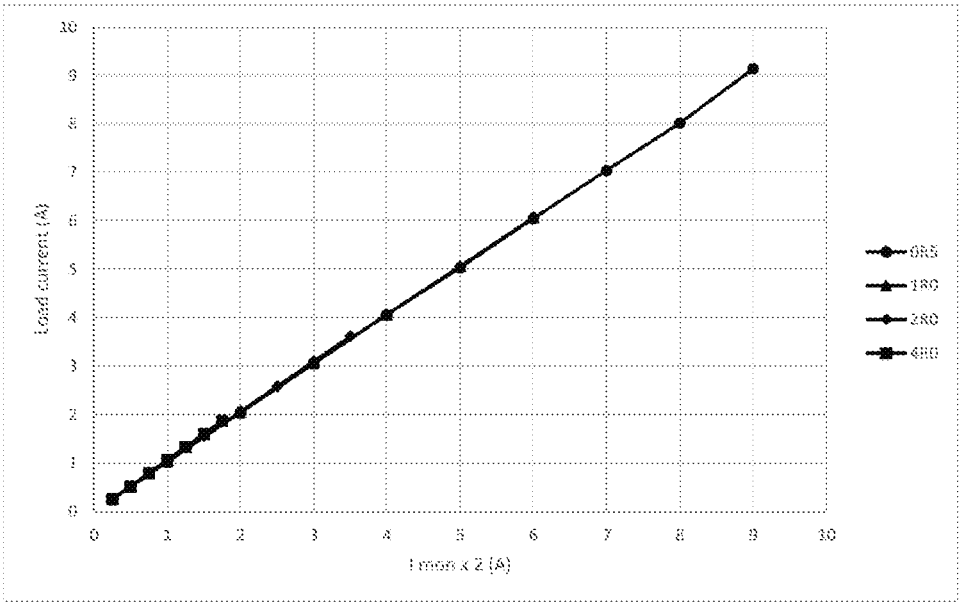
FIG. 3 is a plot of load current of a dummy load against 2× the monitor output of the system of FIG. 1.
Figure 4:
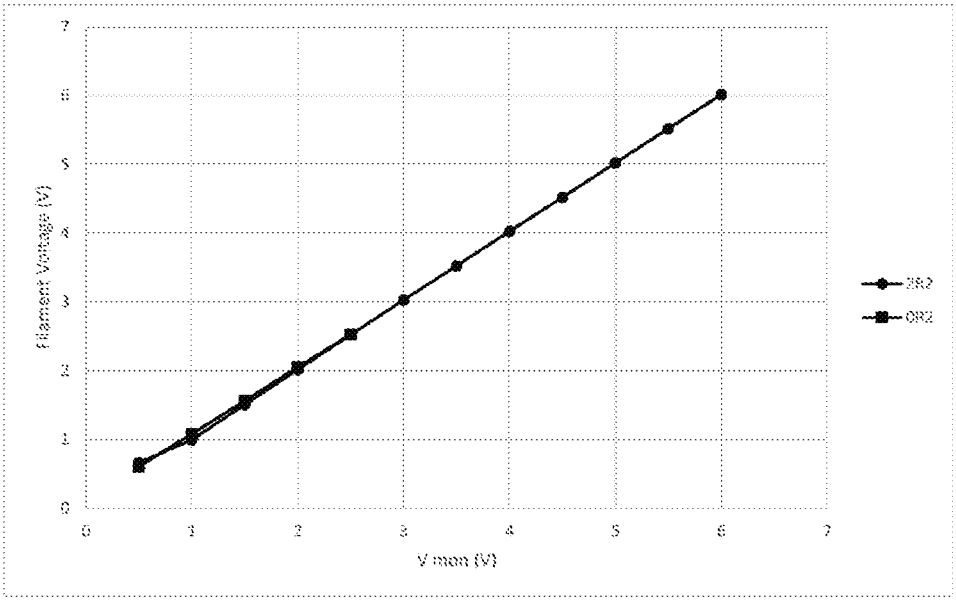
FIG. 4 is a plot of the filament voltage against monitor output of the system of FIG. 1.

The accuracy of using this system to measure the filament current and voltage has been demonstrated by experiment. The actual current of a dummy load against measured I mon output is shown plotted in FIG. 3, showing that the measured I mon output does indeed accurately reflect the load current. FIG. 4 shows the actual load voltage plotted against the V mon output, where it can be seen that the actual and measured voltages correspond reasonably closely.

Figure 5:
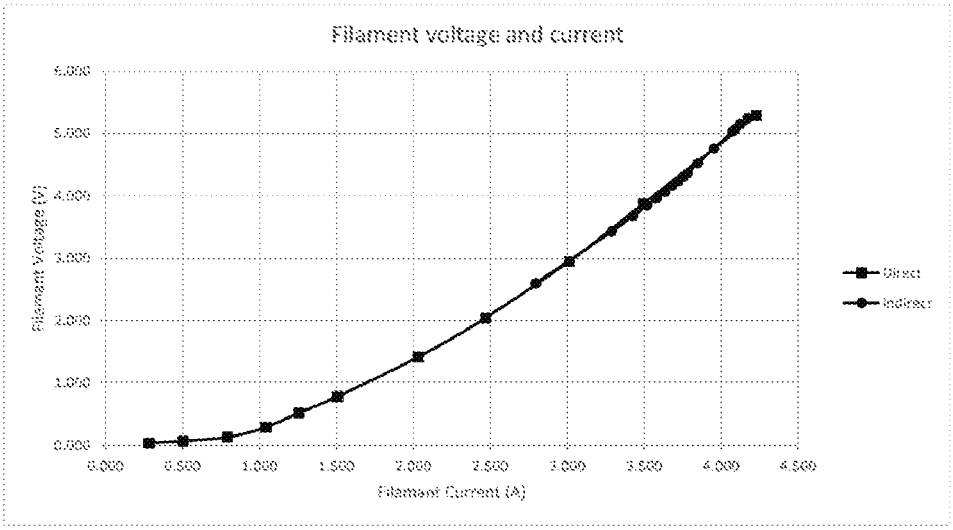
FIG. 5 is a plot of the filament characteristic of a Thales THX 225 WA using a GX225 X-ray generator calculated from measurements using the system of FIG. 1.
Figure 6:
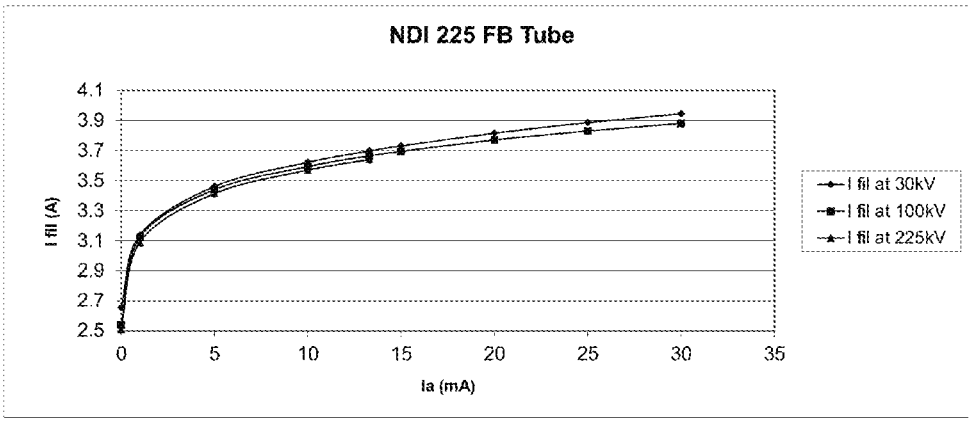
FIG. 6 is a gain plot of NDI 225 FB Tube obtained from measurements using the system of FIG. 1.

FIG. 5 shows a filament characteristic; the squares line shows measurements that have been done directly (No EHT applied), whereas the circular-dot line shows the characteristic measured using the monitor outputs with EHT applied. FIG. 6 shows a gain plot of an X-ray tube produced with EHT applied, and using the monitor outputs.

The invention claimed is:

1. A power transfer and monitoring device for an X-ray tube, the power transfer and monitoring device comprising:

an X-ray filament;

a transformer comprising a primary coil and a secondary coil, wherein the secondary coil of the transformer comprises a first leg, a second leg, and a middle leg;

a current supply configured to supply a sinusoidal current to the primary coil of the transformer, which causes a sinusoidal current in the secondary coil; and a calculation unit configured to measure a primary current of the transformer, configured to determine a synthesized transformer magnetizing current, and configured to subtract the synthesized transformer magnetizing current from the primary current of the transformer to determine a value of filament current through the X-ray filament;

wherein the first leg and the second leg of the secondary coil of the transformer supply current to a first end of the X-ray filament, wherein the middle leg of the secondary coil of the transformer supplies current to a second end of the X-ray filament, and wherein a rectification circuit is included between the secondary coil of the transformer and the X-ray filament, with a capacitor between the rectification circuit and the X-ray filament.

2. The power transfer and monitoring device of claim 1, further comprising:

a regulator configured to supply direct current (DC) voltage to the current supply;

wherein the calculation unit is further configured to measure the DC voltage from the regulator, and using the value of the filament current through the X-ray filament, to calculate a filament voltage.

3. The power transfer and monitoring device of claim 1, wherein the current supply comprises a resonant circuit configured to convert a supply waveform into the sinusoidal current supplied to the primary coil of the transformer.

4. The power transfer and monitoring device of claim 1, wherein the rectification circuit comprises a first diode connected to the first leg of the secondary coil of the transformer, a second diode connected to the second leg of the secondary coil of the transformer.

5. The power transfer and monitoring device of claim 1, wherein the calculation unit is further configured to calculate a filament voltage using the value of the filament current through the X-ray filament.

6. The power transfer and monitoring device of claim 1, further comprising:

a regulator configured to supply direct current (DC) voltage to the current supply.

7. The power transfer and monitoring device of claim 1, wherein the capacitor is in parallel with an output of the rectification circuit.

8. The power transfer and monitoring device of claim 1, wherein the capacitor is in parallel with the X-ray filament.

9. The power transfer and monitoring device of claim 1, wherein the rectification circuit comprises a first diode connected between the first leg of the secondary coil of the transformer and the first end of the X-ray filament, a second diode connected between the second leg of the secondary coil of the transformer and the first end of the X-ray filament, and the middle leg of the secondary coil of the transformer connected to the second end of the X-ray filament.

10. The power transfer and monitoring device of claim 3, wherein the resonant circuit comprises a capacitor.

11. The power transfer and monitoring device of claim 6, wherein the calculation unit is further configured to measure the DC voltage from the regulator.

* * * * *